United States Patent [19]

Takigawa et al.

[11] Patent Number: 4,903,802

[45] Date of Patent: Feb. 27, 1990

[54] SLIDE TYPE EXHAUST BRAKE

[75] Inventors: Kazunori Takigawa, Numazu; Ryoichi Suzuki, Mishima, both of Japan

[73] Assignee: Usui Kokusai Sangyo Kabushiki Kaisha, Shimizu, Japan

[21] Appl. No.: 279,355

[22] Filed: Dec. 2, 1988

Related U.S. Application Data

[63] Continuation of Ser. No. 122,041, Nov. 18, 1987, abandoned.

[51] Int. Cl.[4] ..... F02D 9/06

[52] U.S. Cl. ..... 188/273; 123/323; 137/629; 251/327

[58] Field of Search ..... 188/273, 154; 123/323; 137/629; 251/327

[56] References Cited

U.S. PATENT DOCUMENTS

| | | |
|---|---|---|
| 742,308 | 10/1903 | Gerrard . |
| 795,057 | 7/1905 | O'Brien . |
| 1,436,412 | 11/1922 | Skiffington . |
| 1,620,100 | 3/1927 | Hoxton . |
| 2,845,306 | 7/1958 | Carver . |
| 3,342,203 | 9/1967 | Abercrombie . |
| 3,720,227 | 3/1973 | Curran . |
| 4,062,332 | 12/1977 | Perr . |
| 4,093,046 | 6/1978 | Perr . |
| 4,205,704 | 6/1980 | Benson . |
| 4,408,627 | 10/1983 | Harris . |
| 4,452,269 | 6/1984 | Kindermann . |
| 4,553,648 | 11/1985 | Suzuki et al. . |
| 4,615,354 | 10/1986 | Bianchi . |
| 4,671,489 | 6/1987 | Jankovic . |

FOREIGN PATENT DOCUMENTS

| | | | |
|---|---|---|---|
| 3009453 | 9/1981 | Fed. Rep. of Germany . | |
| 2223602 | 10/1974 | France . | |
| 55-117047 | 9/1980 | Japan . | |
| 55-123328 | 9/1980 | Japan . | |
| 55-123330 | 9/1980 | Japan . | |
| 60-3437 | 9/1985 | Japan . | |
| 233426 | 10/1987 | Japan | 123/323 |
| 14098 | of 1891 | United Kingdom . | |

*Primary Examiner*—George E. A. Halvosa

*Attorney, Agent, or Firm*—Anthony J. Casella; Gerald E. Hespos

[57] ABSTRACT

A slide type exhaust brake having an exhaust pressure regulating passage provided in that portion of the wall of a housing which defines the bottom of a guide passage for a reciprocating valve member such that the exhaust pressure regulating passage extends from the surface of the bottom wall to an exhaust gas flow passage at the downstream side of the valve member when disposed to close the flow passage. The inlet of the exhaust pressure regulating passage is opened or closed by an exhaust pressure regulating valve provided at the distal end of a piston rod of an air cylinder, the piston rod having the valve member movably engaged therewith, in response to the operation of the valve member for opening or closing the flow passage. By virtue of the above-described arrangement, the presence of the exhaust pressure regulating passage has no effect on the mechanical strength of the valve member, and since the inlet of the exhaust pressure regulating passage is opened or closed by the axial movement of the exhaust pressure regulating valve provided at the distal end of the piston rod, there is no fear of wear. Accordingly, it is possible to ensure the tight seal of the inlet of the exhaust pressure regulating passage when the flow passage is closed. Thus, it is possible to effectively maintain the braking function for a long period of time.

2 Claims, 1 Drawing Sheet

PRIOR ART

SLIDE TYPE EXHAUST BRAKE

This application is a continuation of application Ser. No. 122,041, which was filed on Nov. 18, 1987, now abandoned.

BACKGROUND OF THE INVENTION

1. Field of the Invention:

The present invention relates to an improvement in the structure of a slide type exhaust brake which is interposed midway in the exhaust pipe of a large-sized vehicle such as a truck, bus or the like to close the passage of exhaust gas flow when the vehicle is going down a steep slope to thereby apply the brakes to the vehicle.

2. Description of the Prior Art:

AS a prior art of the above-described slide type exhaust brake, the one disclosed in U.S. Pat. No. 4,205,704 is known. Referring to FIG. 2, which is a fragmentary sectional view of the prior art disclosed in the aforementioned U.S. patent, a housing 11 of the exhaust brake defines a flow passage 12 of exhaust gas and a guide passage 13 for receiving a plate-shaped valve member (main gate) 14 and guiding the reciprocating motion thereof, the guide passage 13 being communicated with the flow passage 12 so that the valve member 14 extends into and retracts from the flow passage 12 in a direction substantially perpendicular to the axis of the flow passage 12. The valve member 14 has an exhaust pressure regulating bore (waste gate port) 15 extending through the bottom of the gate surface so as to communicate with the section of the flow passage 11 at the downstream side of the valve member 14 in terms of the direction of flow of the exhaust gas. The valve member 14 further has a pair of abutting walls 14' and 14'' (webs) projecting from its front, or upstream, surface. A piston rod 16 of an air cylinder which is directly secured to the upper end (as viewed in the figure) of the housing 11 is passed through the abutting wall 14' so that the piston rod 16 is movably engaged with the wall 14' and the other abutting wall 14'' is pressed by the distal end of the piston rod 16. A block member (waste gate) 16' is provided on the piston rod 16 so as to be located in the space defined between the abutting walls 14' and 14'', the guide wall 16' abutting against the wall 14' when the flow passage 12 is opened. The block member 16' has an auxiliary valve member (waste gate seal) 16'' which is adapted to close the exhaust regulating bore 15 in response to the operation of the valve member 14 for closing the flow passage 12. When the flow passage 12 is to be opened, the auxiliary valve member 16'' is moved, before the valve member 14 is moved upward, to open the exhaust pressure regulating bore 15, thereby relieving part of the accumulated exhaust gas to the downstream side of the valve member 14 and thus lowering the exhaust pressure acting on the valve member 14. Thereafter, the valve member 14 is activated to open the flow passage 12.

The above-described prior art suffers, however, from the following problems. Since the exhaust pressure regulating bore 15 is provided in the bottom of the gate surface of the valve member 14, the mechanical strength of the valve member 14 itself is lowered. Further, the repetitive opening and closing operations of the valve member 14 in use causes wear of slide contact surfaces. In particular, the area of slide contact between the front surface of the bottom wall of the valve member 14 and the bottom surface of the auxiliary valve member 16'' suffers from considerable wear. When these slide contact surfaces become worn, the auxiliary valve member 16'' is incapable of tightly sealing the exhaust pressure regulating bore 15 when the valve member 14 closes the flow passage 12, resulting in the braking function lowering early, disadvantageously.

SUMMARY OF THE INVENTION

In view of these circumstances, it is a primary object of the present invention to provide a slide type exhaust brake which has overcome considerably effectively the abovedescribed problems of the prior art, the exhaust brake being arranged such that an exhaust pressure regulating passage is provided in that portion of the wall of a housing which defines the bottom of a guide passage for a reciprocating valve member such that the exhaust pressure regulating passage extends from the surface of the bottom wall to an exhaust gas flow passage at the downstream side of the valve member when disposed to close the flow passage and that the inlet of the exhaust pressure regulating passage is opened or closed by an exhaust pressure regulating valve provided at the distal end of a piston rod of an air cylinder, the piston rod having the valve member movably engaged therewith, in response to the operation of the valve member for opening or closing the flow passage. By virtue of the above-described arrangement, the presence of the exhaust pressure regulating means has no effect on the mechanical strength of the valve member, and since the inlet of the exhaust pressure regulating passage is opened or closed by the axial movement of the exhaust pressure regulating valve provided at the distal end of the piston rod, there is no fear of wear. Accordingly, it is possible to ensure the tight seal of the inlet of the exhaust pressure regulating passage when the flow passage is closed. Thus, it is possible to effectively maintain the braking function for a long period of time.

According to the present invention, there is provided a slide type exhaust brake of the type having a housing which has a flow passage of exhaust gas defined by wall portions for connection with an exhaust pipe which project in opposite directions at one end of the housing which further has a guide passage for receiving a plate-shaped valve member and guiding the reciprocating motion thereof, the guide passage being communicated with the flow passage so that the valve member extends into and retracts from the flow passage in a direction substantially perpendicular to the axis of the flow passage, and a piston rod of an air cylinder which is rigidly secured directly to the other end of the housing, the piston rod having the valve member engaged with the distal end portion thereof, thereby activating the valve member to open or close the flow passage in response to the axial movement of the piston rod, wherein an exhaust pressure regulating passage is provided at the bottom wall portion of the housing such that the exhaust pressure regulating passage extends from the surface of the bottom wall to the flow passage at the downstream side of the valve member when disposed to close the flow passage, and the valve member is movably engaged with the distal end portion of the piston rod which extends through a pair of abutting walls projecting from the front, or upstream, surface of the valve member and which has a block member which is engageable with each of the abutting walls, the block member being located between the abutting walls, and wherein the inlet of the exhaust pressure regulating passage is opened or closed by an exhaust pressure regulating valve provided at the distal end of the piston rod in response to the operation of the valve member for opening or closing the flow passage. The exhaust pressure regulating passage may be defined by a bore which extends from the surface of the bottom wall of the guide passage to the flow passage at the downstream side of the valve member when disposed to close the flow passage.

The above and other objects, features and advantages of the present invention will become clear from the following description of the preferred embodiment thereof taken in conjunction with the accompanying drawings.

DETAILED DESCRIPTION OF PREFERRED EMBODIMENT

One embodiment of the present invention will be described hereinunder with reference to the drawings.

Figure 1:
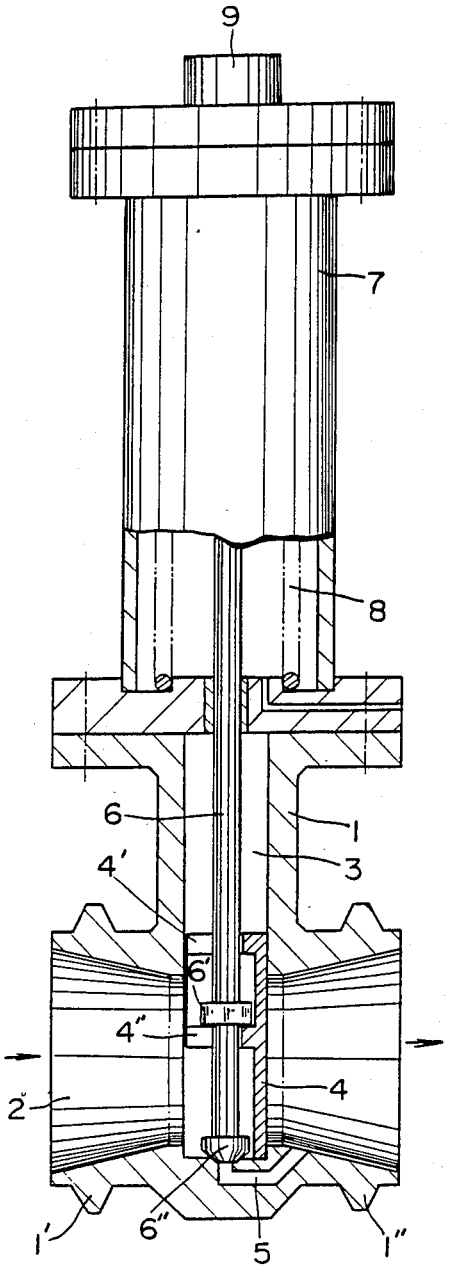
FIG. 1 is a partially-cutaway sectional view of one embodiment of the slide type exhaust brake according to the present invention.
Figure 2:
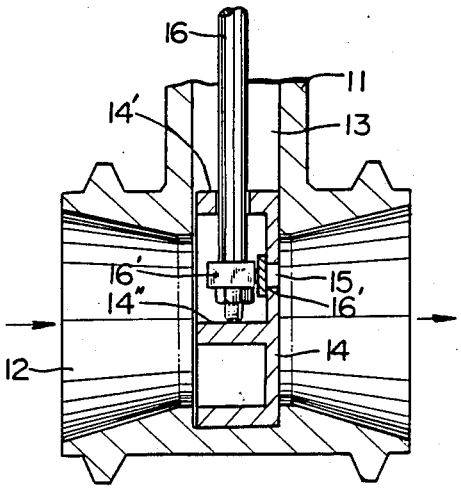
FIG. 2 is a fragmentary sectional view of the prior art disclosed in U.S. Pat. No. 4,205,704.

Referring to FIG. 1, which is a partially-cutaway sectional view of the slide type exhaust brake according to the present invention, a housing 1 of the exhaust brake has a flow passage 2 of exhaust gas defined by wall portions 1' and 1" for connection with an exhaust pipe which project in opposite directions at one end of the housing 1. The housing 1 further has a guide passage 3 for receiving a plate-shaped valve member 4 and guiding the reciprocating motion thereof, the guide passage 3 being communicated with the flow passage 2 so that the valve member 4 extends into and retracts from the flow passage 2 in a direction substantially perpendicular to the axis of the flow passage 2. An air cylinder 7 is rigidly secured to the upper end of the housing 1 through a partition wall. A piston rod 6 of the air cylinder 7 extends through the partition wall and has the valve member 4 engaged with its distal end portion. The valve member 4 is selectively activated to open and close the flow passage 2 in response to the axial movement of the piston rod 6. The valve member 4 has a pair of abutting walls 4' and 4" projecting from its front, or upstream, surface, while the piston rod 6 has a block member 6' located between the abutting walls 4' and 4" so that the block member 6' is engageable with each of the walls 4' and 4", and the piston rod 6 and the valve member 4 are thus movably engaged with each other. The reference numeral 5 denotes an exhaust pressure regulating passage which is provided in that portion of the bottom wall of the housing 1 which defines the lower end of the guide passage 3 such that the passage 5 extends from the surface of said bottom wall to the flow passage 2 which is at the downstream side of the valve member 4 when disposed to close the flow passage 12. An exhaust pressure regulating valve 6" which has a frusto-conical or spherical configuration is provided at the distal end of the piston rod 6. Thus, in response to the operation of the valve member 4 for opening or closing the flow passage 2, the exhaust pressure regulating valve 6" opens or closes the inlet of the exhaust pressure regulating passage 5 which has a configuration complementary to that of the valve 6". More specifically, when the flow passage 2 is to be opened, prior to the upward movement of the valve member 4, the exhaust pressure regulating passage 5 is opened as the exhaust pressure regulating valve 6" provided at the distal end of the piston rod 6 separates from the inlet of the passage 5, thereby relieving part of the accumulated exhaust gas and thus lowering the exhaust pressure acting on the valve member 4. When the flow passage 2 is to be closed, the inlet of the exhaust pressure regulating passage 5 is closed by the valve 6" before the valve member 4 moves downward. The reference numeral 8 denotes a coil spring member for biasing the piston rod 6 upwardly, while the numeral 9 denotes a rapid charge/discharge valve means which is mounted on the upper side of the air cylinder 7 and which is connected to an external high-pressure gas supply source (not shown). It should be noted that the solid-line arrows indicate the direction of flow of exhaust gas.

By virtue of the above-described arrangement of the present invention, when the flow passage 2 is to be closed by the valve member 4, the piston rod 6 is moved downward in response to the supply of a high-pressure gas into the air cylinder 7, causing the block member 6' provided on the piston rod 6 to abut against the wall 4" and thereby pressing the valve member 4 to close the flow passage 2. In addition, the inlet of the exhaust pressure regulating passage 5 is closed by the exhaust pressure regulating valve 6" provided at the distal end of the piston rod 6. Thus, the exhaust brake exhibits its braking function. When the flow passage 12 is to be opened, the upward movement of the piston rod 6 causes the exhaust pressure regulating valve 6" to separate from the inlet of the exhaust pressure regulating passage 5, thereby relieving part of the accumulated exhaust gas to the downstream side of the flow passage 2 through the exhaust pressure regulating passage 5 and thus reducing the exhaust pressure acting on the valve member 4. Further, the valve member 4 is moved upward through the engagement of the block member 6' with the abutting wall 4', thereby opening the flow passage 2 and thus releasing the brakes.

As has been described above, the slide type exhaust brake according to the present invention is arranged such that the exhaust pressure regulating passage 5 is provided in that portion of the wall of the housing 1 which defines the bottom of the guide passage 3 such that the passage 5 extends from the surface of the bottom wall to the flow passage 2 at the downstream side of the valve member 4 when disposed to close the flow passage 2 and that the inlet of the exhaust pressure regulating passage 5 is opened or closed by the exhaust pressure regulating valve 6" provided at the distal end of the piston rod 6 as the valve 6" moves axially of the piston rod 6 in response to the operation of the valve member 4 for opening or closing the flow passage 2. Therefore, the position and structure of the exhaust pressure regulating passage 5 have no effect on the mechanical strength of the valve member 4 itself. In addition, since the inlet of the exhaust pressure regulating passage 5 is opened or closed by the axial movement of the exhaust pressure regulating valve 6" provided at the distal end of the piston rod 6, there is no fear of wear. Accordingly, it is possible to ensure the tight seal of the inlet of the exhaust pressure regulating passage 5 particularly when the flow passage 2 is closed. In addition, since the structure of the exhaust pressure regulating means has no fear of the contact surfaces at the inlet of the passage 5 readily becoming worn, it is possible to effectively maintain the braking function for a long period of time. Thus, it is possible to obtain a considerably useful slide type exhaust brake.

Although the present invention has been described through specific terms, it should be noted here that the described embodiment is not necessarily exclusive and various changes and modifications may be imparted thereto without departing from the scope of the invention which is limited solely by the appended claims.

What is claimed is:

1. A slide type exhaust brake of the type having a housing which has a flow passage for exhaust gas defined by wall portions for connection with exhaust pipes which project in opposite directions at upstream and downstream sides of said housing, said housing further comprising a guide passage for receiving a plate-shaped valve member and guiding reciprocating motion thereof, said guide passage being in communication with said flow passage so that said plate-shaped valve member is selectively extendable into and retractable from said flow passage in a direction substantially perpendicular to the axis of said flow passage, and a piston rod of an air cylinder which is rigidly secured directly to said housing such that an end of said piston rod moves reciprocally in said guide passage, a portion of the piston rod being mounted to the upstream side of the plate-shaped valve member and thereby activating said plate-shaped valve member to open or close said flow passage and to perform an exhaust pressure regulating operation in response to the axial movement of said piston rod, wherein the improvement comprises:

an exhaust pressure regulating passage formed in the wall portions of said housing and extending directly between an outlet at a location in said flow passage downstream of said plate-shaped valve member and an inlet at location in said flow passage upstream of said plate-shaped valve member, the inlet being at a location in said housing substantially opposite said guide passage and in line with the end of the piston rod;

an exhaust pressure regulating valve disposed at the end of said piston rod and in alignment with the inlet of said exhaust pressure regulating passage, said exhaust pressure regulating valve being movable with the piston rod to alternately block and open the inlet to the exhaust pressure regulating passage;

a block fixedly mounted to said piston rod at a location spaced from the end thereof; and first and second spaced apart walls extending rigidly from the upstream side of said plate-shaped valve member and generally transverse to the alignment of said piston rod, said first wall being disposed intermediate the block and the exhaust pressure regulating valve and at a location on said plate-shaped valve member such that the block urges said plate-shaped valve member into position for closing the flow passage substantially when the exhaust pressure regulating valve blocks the inlet to the exhaust pressure regulating passage, said second wall being disposed on said plate-shaped valve member intermediate the block and the cylinder, such that movement of the piston rod into the cylinder initially causes the exhaust pressure regulating valve to completely open the inlet to the exhaust pressure regulating passage, and such that subsequent movement of the piston rod into the air cylinder causes the block to contact the second wall and urge the plate-shaped valve member out of the flow passage, whereby initial movement of the piston rod into the air cylinder relieves pressure on the upstream side of the plate-shaped valve member and facilitates the subsequent opening of the plate-shaped valve member by the block and the piston rod.

2. A slide type exhaust brake according to claim 1, wherein said exhaust pressure regulating valve has a frusto-conical or spherical configuration, and the inlet of said communicating means has an opening having a frusto-conical or spherical configuration which is complementary to that of said exhaust pressure regulating valve.

* * * * *